United States Patent [19]

Tanaka et al.

[11] Patent Number: 4,844,437

[45] Date of Patent: Jul. 4, 1989

[54] SHEET SEPARATING ARRANGEMENT

[75] Inventors: Hironori Tanaka, Nara; Matahira Kotani, Ikoma; Masafumi Matsumoto, Nara-ken, all of Japan

[73] Assignee: Sharp Kabushiki Kaisha, Osaka, Japan

[21] Appl. No.: 55,361

[22] Filed: May 29, 1987

[30] Foreign Application Priority Data

May 30, 1986 [JP] Japan ..... 61-83458

[51] Int. Cl.[4] ..... B65H 3/52

[52] U.S. Cl. ..... 271/124

[58] Field of Search ..... 271/121, 124

[56] References Cited

U.S. PATENT DOCUMENTS

| | | | |
|---|---|---|---|
| 2,080,968 | 5/1937 | Krell | 271/124 |
| 4,457,507 | 7/1984 | Ishikawa | 271/121 |
| 4,667,244 | 5/1987 | Ishikawa | 271/121 X |
| 4,674,737 | 6/1987 | Murayoshi | 271/124 |

FOREIGN PATENT DOCUMENTS

| | | | |
|---|---|---|---|
| 102345 | 6/1985 | Japan | 271/121 |

*Primary Examiner*—Richard A. Schacher

*Attorney, Agent, or Firm*—Birch, Stewart, Kolasch & Birch

[57] ABSTRACT

A sheet separating arrangement including a sheet feeding roller and a separating rubber plate held in contact under pressure with the sheet feeding roller both of which are provided along a transport path so as to successively send out sheets transported via the transport path sheet by sheet, between the sheet feeding roller and the separating rubber plate, characterized in that there is provided a separating spring which is formed of an adjustable plate spring for urging the separating rubber plate so as to be depressed onto the sheet feeding roller. The separating spring is held in direct contact with the separating rubber plate and fixed to a fixing plate by a screw member.

6 Claims, 2 Drawing Sheets

SHEET SEPARATING ARRANGEMENT

BACKGROUND OF THE INVENTION

The present invention generally relates to a sheet separating apparatus and more particularly, to a sheet separating arrangement used for smoothly transporting sheets, e.g., paper sheets such as original documents containing various information, sheets for recording and reproducing, etc. piled up in a stack, towards a reading section or recording and reproducing section through separation sheet by sheet, in such appliances as a facsimile apparatus, copying apparatus, optical character reading device, or the like.

Conventionally, a known sheet separating arrangement used for the purpose as described above generally has the construction as shown in FIG. 1, and includes a transport path 3 defined between a lower sheet guide plate 1 and an upper sheet guide plate 2 for guiding sheets, for example, paper sheets such as original documents, etc., a pay-out roller 4, a depressing member 5 held in pressure contact with the pay-out roller 4, a sheet feeding roller 6, a transport roller 7 and a pinch roller 8 held in pressure contact with the transport roller 7, which are sequentially disposed along the transport path 3 from the upstream side in the transport direction, as illustrated.

The depressing member 5 referred to above and pivotally connected to a frame (not shown) by a shaft 9, is held in pressure contact with the pay-out roller 4 by an urging force of a depressing spring 10 connected between the depressing member 5 and the upper sheet guide plate 2, and is prevented from further rotation by the contact of a stopper 11 projecting therefrom, with the corresponding surface of the upper sheet guide plate 2.

In a position above the sheet feeding roller 6, there is provided a sheet separating unit 12 which separates sheets for feeding one sheet at a time. The sheet separating unit 12 includes a separating member **12*b* having an L-shaped cross section and pivotally connected to the frame by a shaft 12*a* so as to be inclined in the sheet feeding direction, a separating plate 12*c* of rubber or rubber-like material superior in abrasion resistance and fixed to the under surface of the separating member 12*b*, and a compression coil spring 12*e* disposed between an angle member 12*d* sescured to the upper sheet guide plate 2 and the separating member 12*b* for urging the separating member 12*b* toward the sheet feeding roller 6 so as to keep the separating rubber sheet 12*c* in pressure contact with the roller 6 under a predetermined pressure, thereby to effect the function of separating the sheets as fed, into individual sheets. Moreover, since it is difficult to separate a large number of sheets stacked on a hopper 13 into individual sheets only by the sheet separating unit 12, there is provided a sheet stopper member 14 on the upper sheet guide plate 2 at a position close to the contacting point between the pay-out roller 4 and the depressing member 5 so as to be inclined toward the sheet feeding direction and also spaced from the surface of the lower sheet guide plate 1 by a predetermined distance, and thus, movement of the sheets is restricted by this sheet stopper member 14 so that more sheets than necessary are not fed to the sheet separating unit 12**.

However, in the sheet separating unit 12 as described above, since the urging of the separating rubber plate **12*c* toward the sheet feeding roller 6 is to be effected by the compression coil spring 12*e*, it is necessary to forcibly fit the coil spring 12*e* in between the separating member 12*b* and the angle member 12*d*, thus resulting in low efficiency during assembly work. Moreover, due to the complicated structure for supporting the separating member 12*b* by the shaft 12*a* mounted on the frame for merely bringing the separating rubber plate 12*c* into pressure contact with the sheet feeding roller 6**, the number of parts is undesirably increased, with a corresponding increase in cost.

Furthermore, since the urging pressure toward the separating rubber plate **12*c* as determined by the spring constant of the coil spring 12*e* can not be adjusted, in cases where any trouble such as faulty sheet feeding or the like arising from the pressure of the separating rubber plate 12*c*** should take place during operation by users, it becomes necessary to replace the coil spring with another one having a different spring constant.

SUMMARY OF THE INVENTION

Accordingly, an essential object of the present invention is to provide a sheet separating arrangement which is capable of urging a separating rubber plate to a sheet feeding roller through an extremely simple means, while the urging pressure may be readily adjusted as desired.

Another important object of the present invention is to provide a sheet separating arrangement of the above described type, which is simple in construction and accurate in function, and can be readily incorporated into applicable appliances at low cost.

In accomplishing these and other objects, according to one preferred embodiment of the present invention, there is provided a sheet separating arrangement including a sheet feeding roller and a separating rubber plate held in contact under pressure with the sheet feeding roller, along a transport path so as to successively send out sheets transported via the transport path one sheet at a time, between the sheet feeding roller and the separating rubber plate, characterized in that there is provided a separating spring which is formed of a plate spring for urging the separating rubber plate so as to be depressed onto the sheet feeding roller, with the separating spring being held in direct contact with the separating rubber plate and fixed to a fixing plate by a screw means.

By the construction according to the present invention as described above, the separating spring made of a plate spring may be fixed to the fixing plate, for example, by one screw, while owing to the structure that the separating spring is directly held in pressure contact with the separating rubber plate without the disposition of any other member therebetween, the number of parts required is decreased for reduction in cost and for simple and quick assembly. Moreover, since the spring pressure may be varied by altering the fixing position of the separating spring by the screw means, the urging pressure to the separating rubber plate can be readily adjusted.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
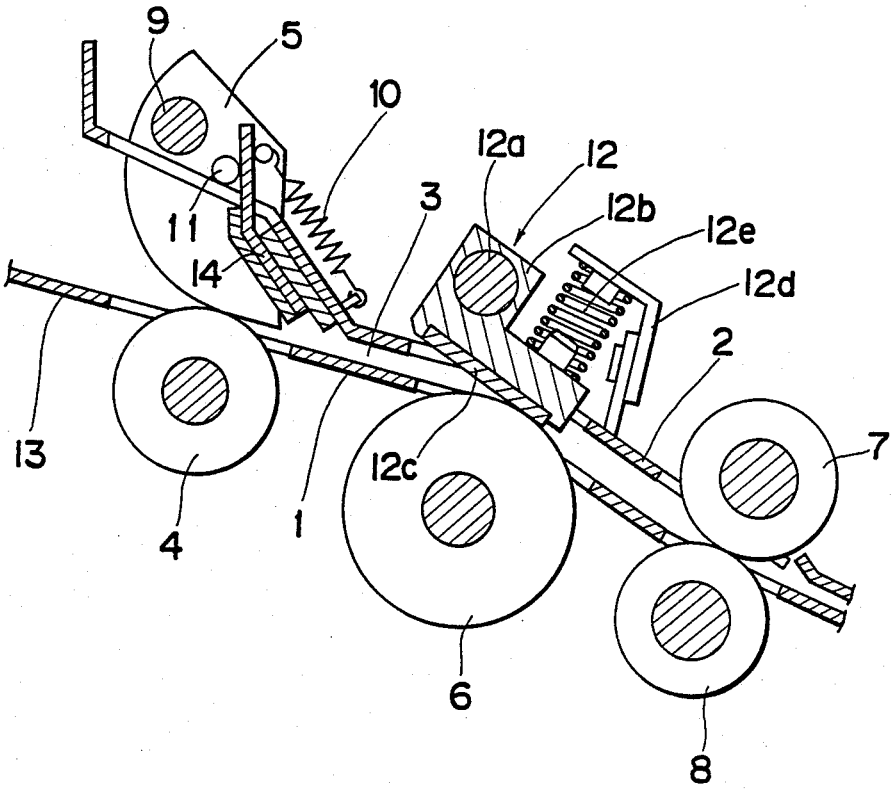
Fig. 1 PRIOR ART
FIG. 1 is a fragmentary side sectional view of a conventional sheet separating arrangement (already referred to)

Before the description of the present invention proceeds, it is to be noted that like parts are designated by like reference numerals throughout the accompanying drawings.

Figure 2:
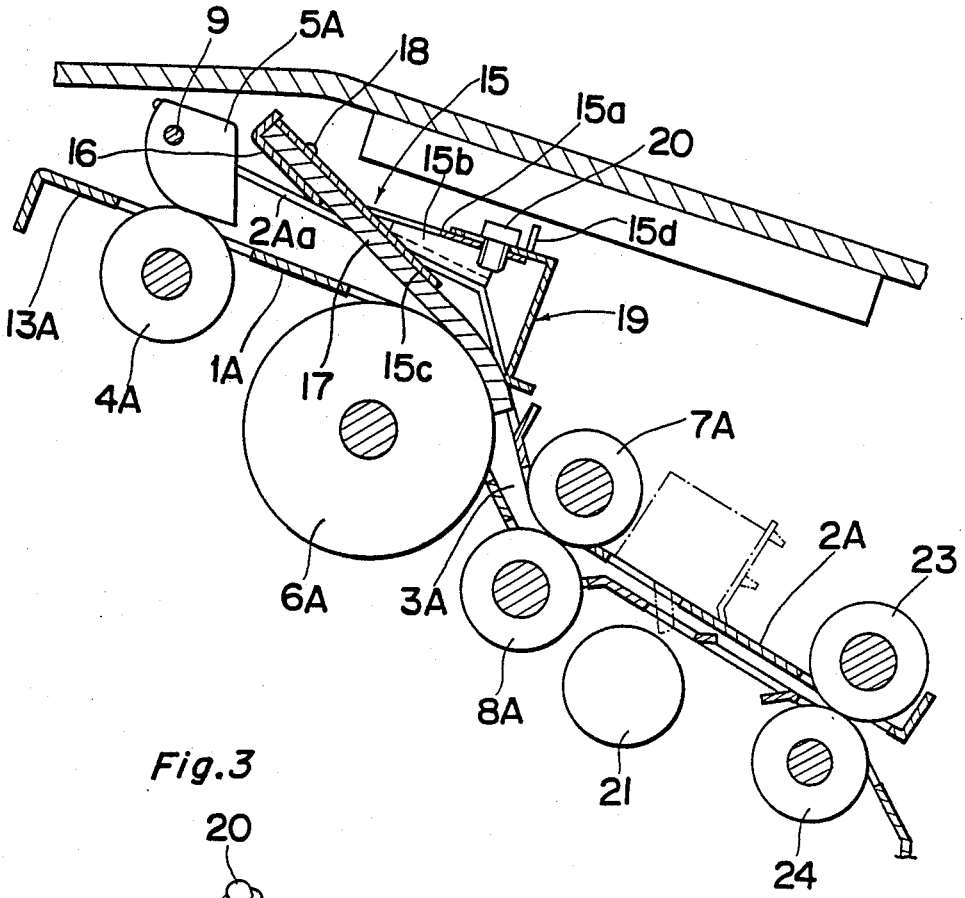
FIG. 2 is a fragmentary side sectional view of a sheet separating arrangement according to one preferred embodiment of the present invention.

Referring now to the drawings, there is shown in FIG. 2 a sheet separating arrangement according to one preferred embodiment of the present invention.

The sheet separating arrangement in FIG. 2 generally includes a transport path 3A defined between a lower sheet guide plate 1A and an upper sheet guide plate 2A for guiding sheets, for example, paper sheets such as original documents, etc., a pay-out roller 4A and a depressing member 5A held in pressure contact with the pay-out roller 4A, a sheet feeding roller 6A, a transport roller 7A and a pinch roller 8A held in pressure contact with the transport roller 7A, which are sequentially disposed along the transport path 3A from the upstream side toward the downstream side in the transport direction in a similar manner as in the conventional arrangement of FIG. 1.

In the sheet separating arrangement according to the present invention in FIG. 2, however, the sheet separating unit 12 described as employed in the known arrangement of FIG. 1 is replaced by a fixing plate 15 having a fixing portion 15*a* for a separating spring 19 (described later), cut and raised from the plate 15 by forming a U-shaped cut in the plate 15, and fixing portions 15*b* bent to extend downwardly from opposite sides of the fixing portion 15*a* (FIG. 3) so as to secure the fixing plate 15 onto the upper sheet guide plate 2A by screws (not shown) in a position confronting the sheet feeding roller 6A. A main plate portion 15*c* of this fixing plate 15 is inserted into the sheet transport path 3A through an opening 2A*a* formed in the upper sheet guide plate 2A, in a state inclined along the sheet feeding direction, while a separating plate 17 of rubber or rubber-like material (referred to as a separating rubber sheet hereinafter) is held between the under surface of the main plate portion 15*c* and a securing plate 16 at the forward end portion of the plate 17 in the sheet feeding direction so as to be fixed by screws 18, with the rear end portion of the plate 17 in the sheet feeding direction being held in contact with the sheet feeding roller 6A.

Figure 3:
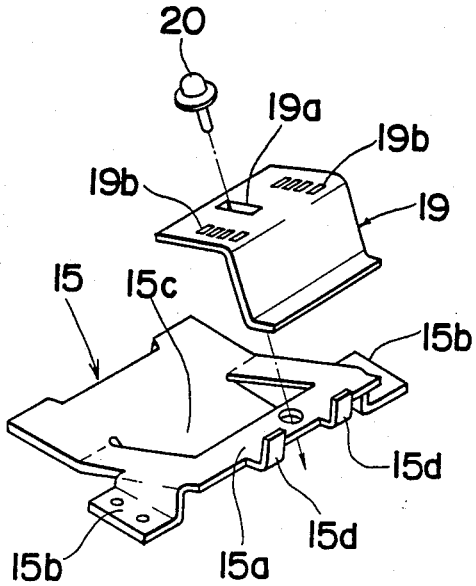
FIG. 3 is an exploded perspective view of a separating spring and a fixing plate therefor, which are employed in the arrangement of FIG. 2.

As shown in FIG. 3, the separating spring 19 is formed by bending a rectangular plate approximately at its central portion, into a generally L-shaped cross section, and is secured to the fixing portion 15*a* of the fixing plate 15 by a screw 20, with the lower end of the spring 19 being directly held under pressure in contact with the separating rubber plate 17 (FIG. 2). A fixing hole 19*a* formed in the separating spring 19 for insertion of the fixing screw 20 therethrough has a shape elongated in a direction parallel to the separating rubber plate 17, i.e., in the sheet feeding direction, and thus, it is made possible to adjust the urging pressure of the separating spring 19 toward the separating rubber plate 17 by displacing the fixing position of the spring by the screw 20, along the elongated fixing hole 19*a*. As a means for adjusting the pressure, a set of four equally spaced pressure adjusting holes 19*b* are formed in the separating spring 19 at each side of the elongated fixing hole 19*a* in a parallel relation thereto so as to respectively receive a pair of pressure adjusting projections 15*d* formed to extend upwardly from the fixing portion 15*a* of the fixing plate 15.

In the above embodiment of FIG. 2, the sheet separating arrangement is shown as applied to a facsimile apparatus, and there are further provided, along the transport path 3A, an optical reading device (not shown) having a fluorescent light 21 as a light source, and a pair of sheet discharge rollers 23 and 24 at the downstream side of the transport roller 7A in the sheet feeding direction.

Subsequently, functions of the sheet separating arrangement described so far with reference to FIGS. 2 and 3 will be described hereinafter.

When a plurality of sheets such as paper sheets for original documents, etc. are set in a stack on the hopper portion 13A, the paper sheets are sequentially transported in the direction of the transport path 3A, from the sheets located at the lower portion of the stack, by the rotational driving of the pay-out roller 4A and the depressing function of the depressing member 5A. In the embodiment of FIG. 2, the stopper member 14 shown in the prior art arrangement of FIG. 1 is eliminated, and the main plate portion 15*c* of the fixing plate 15 is commonly used as a stopper member. In the case where a large number of sheets are fed simultaneously, the main plate portion 15*c* prevents, through the separating rubber plate 17, the sheets from being fed between the separating rubber plate 17 and the sheet feeding roller 6A at the same time. Meanwhile, the separating rubber plate 17 functions to positively separate the fed sheets one sheet at a time, and thus, the sheets are advantageously separated by the separating rubber plate 17 and the sheet feeding roller 6A so as to be fed, one sheet at a time, into the transport path 3A at the further downstream side thereof. The sheet thus separated is fed to the optical reading device (not shown) through the transport roller 8A and the pinch roller 7A, and is discharged via the discharge rollers 23 and 24 after the information written on the sheet has been optically read by the optical reading device.

In the sheet separating arrangement according to the present invention, since the separating spring 19 is constituted of the plate spring, it can be attached by one screw 20, while, owing to the construction that the separating spring 19 may be directly pressed against the separating rubber plate 17 without any other intervening member, the arrangement can be assembled extremely easily and quickly, while, due to the simple construction through reduction of the number of parts, a considerable reduction in cost may be achieved.

Moreover, since the urging pressure of the separating spring 19 toward the separating rubber plate 17 is adapted to be adjustable by inserting the projections 15*d* into each of the four pressure adjusting holes 19 properly selected, any trouble such as faulty feeding of sheets, etc. related to the separating rubber plate 17 may be quickly dealt with, without the necessity for replacement of the spring, etc.

It is to be noted here that the present invention is not limited in its application to the foregoing embodiment alone, but may be modified in various ways within the scope. By way of example, it may be so modified that the multiple holes for receiving the projections 15*d* of the fixing plate 15 are formed as two elongated holes in the separating spring 19, while the fixing hole 19*a* for receiving the fixing screw 20 is replaced by a plurality of holes arranged in the separating spring so as to adjust the pressure through selection of the appropriate pressure adjusting projection, and in this modified arrangement also, similar effects as in the embodiment described so far may be obtained.

As is clear from the foregoing description, according to the sheet separating arrangement of the present invention, since the separating spring for depressing the separating rubber plate against the sheet feeding roller is formed by the plate spring, while the separating spring is directly pressed against the separating rubber plate and secured to the fixing plate by the screw, actual attachment of the separating spring is markedly facilitated owing to the fixing by the screw, as compared with that in the conventional arrangement employing the compression coil spring for the purpose. Moreover, since the separating spring is directly pressed against the separating rubber plate without intervention of any other member, the number of parts can be markedly reduced, with a consequent improvement of efficiency during assembling, and thus, cost reduction may be achieved to a large extent by the reduction of time for the assembly and the number of parts involved.

Furthermore, owing to the construction to attach the separating spring by fixing with the screw, pressure may be adjusted by altering the length between the fixing point and the acting point through alteration of the fixing point by the screw, and thus, troubles such as faulty sheet feeding, etc. arising from improper pressure onto the separating rubber plate can be treated readily and quickly.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A sheet separating unit which includes a sheet feeding roller, a separating rubber plate held in contact under pressure with said sheet feeding roller, each of said feeding roller and rubber plate being provided along a transport path for said sheets transported via said transport path sheet by sheet between said sheet feeding roller and said separating rubber plate, and an adjustable separating plate spring for urging said separating rubber plate against said sheet feeding roller, said separating plate spring being held in direct contact with said separating rubber plate by a fixing plate, said separating plate spring being provided with a fixing hole therein for inserting a screw means therethrough so as to adjustably secure said plate spring to said fixing plate, said fixing hole being formed as an elongated opening extending parallel to said separating rubber plate in the direction of said sheet feeding transport path, said separating plate spring being further formed with a plurality of pressure adjusting holes for receiving corresponding projections from said fixing plate, said pressure adjusting holes being formed on either side of and parallel to said fixing hole.

2. The sheet separating unit of claim 1, wherein two fixing projections are provided on said fixing plate.

3. A sheet separating unit which includes a sheet feeding roller, a separating rubber plate held in contact under pressure with said sheet feeding roller, each of said feeding roller and rubber plate being provided along a transport path for said sheets transported via said transport path sheet by sheet between said sheet feeding roller and said separating rubber plate, and an adjustable separating plate spring for urging said separating rubber plate against said sheet feeding roller, said separating plate spring being held in direct contact with said separating rubber plate by a fixing plate, said separating plate spring being provided with a plurality of pressure adjusting holes therein formed parallel to said separating rubber plate in the direction of said sheet feeding transport path for selectively receiving corresponding pressure adjusting projections from said fixing plate, said separating plate spring being further provided with two elongated fixing holes on either side of and parallel with said plurality of pressure adjusting holes for inserting respective screw means therethrough so as to secure said plate spring to said fixing plate.

4. The sheet separating unit of claim 3, wherein one fixing projection is provided on said fixing plate.

5. A sheet separating unit which includes a sheet feeding roller, a separating rubber plate held in contact under pressure with said sheet feeding roller, each of said feeding roller and rubber plate being provided along a transport path for said sheets transported via said transport path sheet by sheet between said sheet feeding roller and said separating rubber plate, and an adjustable separating plate spring for urging said separating rubber plate against said sheet feeding roller, said separating plate spring being held in direct contact with said separating rubber plate by a fixing plate, wherein said separating plate spring is provided with a fixing hole therein for inserting a screw means therethrough so as to adjustably secure said plate spring to said fixing plate, said fixing hole being formed as an elongated opening extending parallel to said separating rubber plate in the direction of said sheet feeding transport path.

6. A sheet separating unit which includes a sheet feeding roller, a separating rubber plate held in contact under pressure with said sheet feeding roller, each of said feeding roller and rubber plate being provided along a transport path for said sheets transported via said transport path sheet by sheet between said sheet feeding roller and said separating rubber plate, and an adjustable separating plate spring for urging said separating rubber plate against said sheet feeding roller, said separating plate spring being held in direct contact with said separating rubber plate by a fixing plate, wherein said separating plate spring is provided with a plurality of pressure adjusting holes formed parallel to said separating rubber plate in the direction of said sheet feeding transport path for selectively receiving corresponding pressure adjusting projections from said fixing plate.

* * * * *